US007568694B2

(12) United States Patent
Sparer et al.

(10) Patent No.: US 7,568,694 B2
(45) Date of Patent: Aug. 4, 2009

(54) PRINTED MEDIUM COLLECTOR

(75) Inventors: Steven J. Sparer, Rochester, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 239 days.

(21) Appl. No.: 11/604,498

(22) Filed: Nov. 27, 2006

(65) Prior Publication Data

US 2008/0122164 A1 May 29, 2008

(51) Int. Cl.
*B65H 31/00* (2006.01)
*B65H 31/26* (2006.01)

(52) U.S. Cl. ..... 271/207; 271/220

(58) Field of Classification Search ..... 271/207, 271/220; 347/104; 399/405; 400/646
See application file for complete search history.

(56) References Cited

U.S. PATENT DOCUMENTS 4,155,643 A * 5/1979 Ladds et al. ..... 355/72
4,696,591 A 9/1987 Boyden
4,936,698 A 6/1990 Clyburn
2004/0045844 A1 * 3/2004 Beauchamp ..... 206/307

FOREIGN PATENT DOCUMENTS

WO WO 2005/070674 8/2005

* cited by examiner

*Primary Examiner*—David H Bollinger
(74) *Attorney, Agent, or Firm*—Roland R. Schindler, II; David A. Novais; Eugene I. Shkurko

(57) ABSTRACT

A printed medium collector comprises a guide surface downwardly inclined from an intake edge toward a drop off edge. A printed medium passes from the intake edge and over the drop off edge and travels away from the guide surface within a range of trajectories. A printed medium storage area receives any printed medium with a leading edge moving within the range of trajectories. The printed medium storage area has a support surface and a stop to block lateral travel of the printed mediums so that such printed mediums are stored to form a stack. The support surface and stop are positioned such that the leading edge of a printed medium that follows the range of trajectories will laterally travel past the trailing edge of each of the printed mediums in the stack before the leading edge passes downward of the trailing edge.

11 Claims, 9 Drawing Sheets

PRINTED MEDIUM COLLECTOR

FIELD OF THE INVENTION

The present invention relates to collecting devices for collecting printed mediums after printing.

BACKGROUND OF THE INVENTION

Electronic copiers, photofinishing devices, inkjet printers and/or other forms of printers are commonly used to render multi-page compilations of printed materials such as multi-page documents, sequences of images and the like. Typically, it is desired that the pages of such documents be presented to the user in an orderly and sequential fashion. Accordingly, automatic collation and arrangement of printed material is a highly desirable feature in printers.

Some printers incorporate advanced collating systems that actively work to arrange printed pages to provide features such as multi-document collation, stapling, folding and the like. For example, U.S. Pat. No. 4,696,591 to Boyden, issued Sep. 29, 1987, entitled "Fan Folded Printer Output Collector," describes a printer output collector useful in printers that print on so-called fan folded paper. In this patent a printer having a fan folded output is provided with an output catching tray which cantilevers upwardly at an angle of 35-55 degrees from the printer output. The tray includes side walls defining a bottom which bears on the top of the printer. The sidewalls each define integrally formed hooks for catching onto the printer at any bar of fastening disposed in the area of the output. These hooks enable the cantilevered support to occur. At the bottom of the tray, an arcuate and cam-like surface is disposed against the printer output. This cam-like surface takes horizontal output from the printer and causes it to pass upwardly over its surface. The cam surface extends from an angle in the range of 45 degrees in vicinity of the printer to a slope beyond horizontal at the bottom of the paper catching tray. The end of the cam and the bottom of the paper catching tray form a notch. The paper catching tray extends upward from the notch at an angle between 30 to 60 degrees, the full length of the fan fold paper, and is preferably provided at the upper end thereof with a paper stop. In operation, fan folded paper output from the printer is fed to the tray, typically to the notch at the end of the cam surface and the beginning of the upwardly extending tray. Thereafter, when printer output occurs, the columnar strength of the paper combined with the natural weight of the paper as it lies on the tray surface causes a fan fold layering of the paper catching tray.

The system provided in the '591 patent allows a user to view the printed output of the printer soon after printing which in turn allows real time print monitoring and job interruption where necessary. However, it will be appreciated that this system requires a printer that is capable of actively driving movement of the receiver medium even after printing is complete. EP 0 183 413 A2, to Prevignano, issued Aug. 1, 1990, describes a sheet feeder that can supply both cut sheets and continuous media for an office printing or typing machine. After printing such media is advanced by the printer against gravity into a collector tray. The collector tray simply receives such material.

However, such active driving systems can be costly and complex. What is needed therefore is a system that can collect printed mediums in a sequentially collated and orderly way but without actively driving the printed pages after printing.

There have been attempts to provide such systems. For example, U.S. Pat. No. 4,936,698 to Clyburn, issued Jun. 26, 1990, entitled "Printer Stand with Print-Out Catcher," describes a printer stand that comprises a support base for holding a rear-ejection printer and a paper catcher mounted to the rear of the printer and extending rearwardly and upwardly therefrom. The catcher comprises a flat backer panel having bent-up side flanges and having a bent-up lower ledge for supporting the lower edge of a packet of sheets of paper resting against the backer panel. The catcher is mounted to the base for easy removal by providing a forwardly and downwardly extending slot at the rear of each side wall of the support base, into and out of which the panel can readily be slid; the side flanges are preferably spaced apart by only slightly more than the distance between the outer sides of the side walls, and the ledge is preferably at about right angles to the packer panel. The system provides stable support of the packet of sheets, is easily assembled and disassembled, and is inexpensively made from a single metal sheet by bending up the side flanges and the ledge. The system, however, is best adapted to receive and collate sheet mediums having a fixed length.

WO 2005/070674 to King et al., published on Aug. 4, 2005, entitled "A Printer Unit Employing Vertically Disposed Media Storage and Collection Areas" describes a printer unit employing substantially vertically disposed media storage and collection areas. In this system a transport device is provided to transport print media through a delivery path which passes through an angle of at least 140 degrees and preferably 180 degrees from the supply area to the collector area. A foot portion is arranged to project into the substantially vertical path of the ejected sheets and has a contact surface that is arranged to contact a leading edge of the sheets to stop movement thereof along the substantially vertical path. The contact surface is arranged to urge the sheets toward the collection surface for collection, such as by having an angle that is inclined from the vertical path. Optionally, an outlet from which the sheets are ejected can be arranged with respect to the foot portion so that the ejected sheets are allowed to fall under gravity to assume the substantially vertical path. To retain media within the storage area, the guide ribs are shaped to impart a curvature of the media.

While the '674 publication provides a good solution for organizing printed media, this solution requires that the printing system have a substantially vertical profile which may not be suitable or desirable in many applications. Further, it will be appreciated that many printers and printing technologies use a generally horizontally configured print head, which is not compatible with such a vertical configuration.

Further, as illustrated in FIG. 1, a printer 8 of the kind that is described in the '674 publication will store previously printed sheets 10 in a vertical stack in storage area 12. Such stacks of previously printed sheets are stored with trailing edges 14 thereof arranged in a manner that can interfere with the movement of the leading edge 16 of a recently printed sheet 18 after recently printed sheet 18 leaves the nip between printhead 17 and a platen 19 or is otherwise released from the positional control by printer 8. This can cause damage to edges 14 or 16, can disrupt the arrangement of previously printed sheets 10 by causing previously printed sheets 10 to move, or by inserting recently printed sheet 18 within previously printed sheets 10. In certain circumstances, recently printed sheet 18 could be held in print head 17 in a manner that can interfere with future printing operations.

What is needed, therefore, is a print storage and collation system that can be used to provide a more horizontal profile while also providing greater reliability and without requiring active driving of the recently printed sheets.

SUMMARY OF THE INVENTION

In one aspect, a printed medium collector is provided. The printed medium collector comprises a guide surface having an intake edge and a drop off edge, with the guide surface being downwardly inclined from the intake edge toward the drop off edge such that when a printer releases a printed medium onto the guide surface, the printed medium can be drawn by gravity across the guide surface and over the drop off edge with a leading edge of the printed medium moving within a range of trajectories, each trajectory having a downward and lateral component and a printed medium storage area arranged to receive any printed medium with a leading edge moving within the range of trajectories, the printed medium storage area having a support surface to provide support against downward movement of the printed medium and a stop extending above the support surface to an extent that is sufficient to engage a leading edge of any printed mediums received by the print storage area to block lateral travel of the printed mediums so that such printed mediums are stored on the support surface against the stop to form a stack. The support surface and stop are positioned at an elevation and at a lateral location relative to the drop off edge such that the leading edge of a printed medium that follows the range of trajectories will laterally travel past the trailing edge of each of the printed mediums in the stack before the leading edge passes downward of the trailing edge of that printed medium.

DETAILED DESCRIPTION OF THE INVENTION

Figure 1:
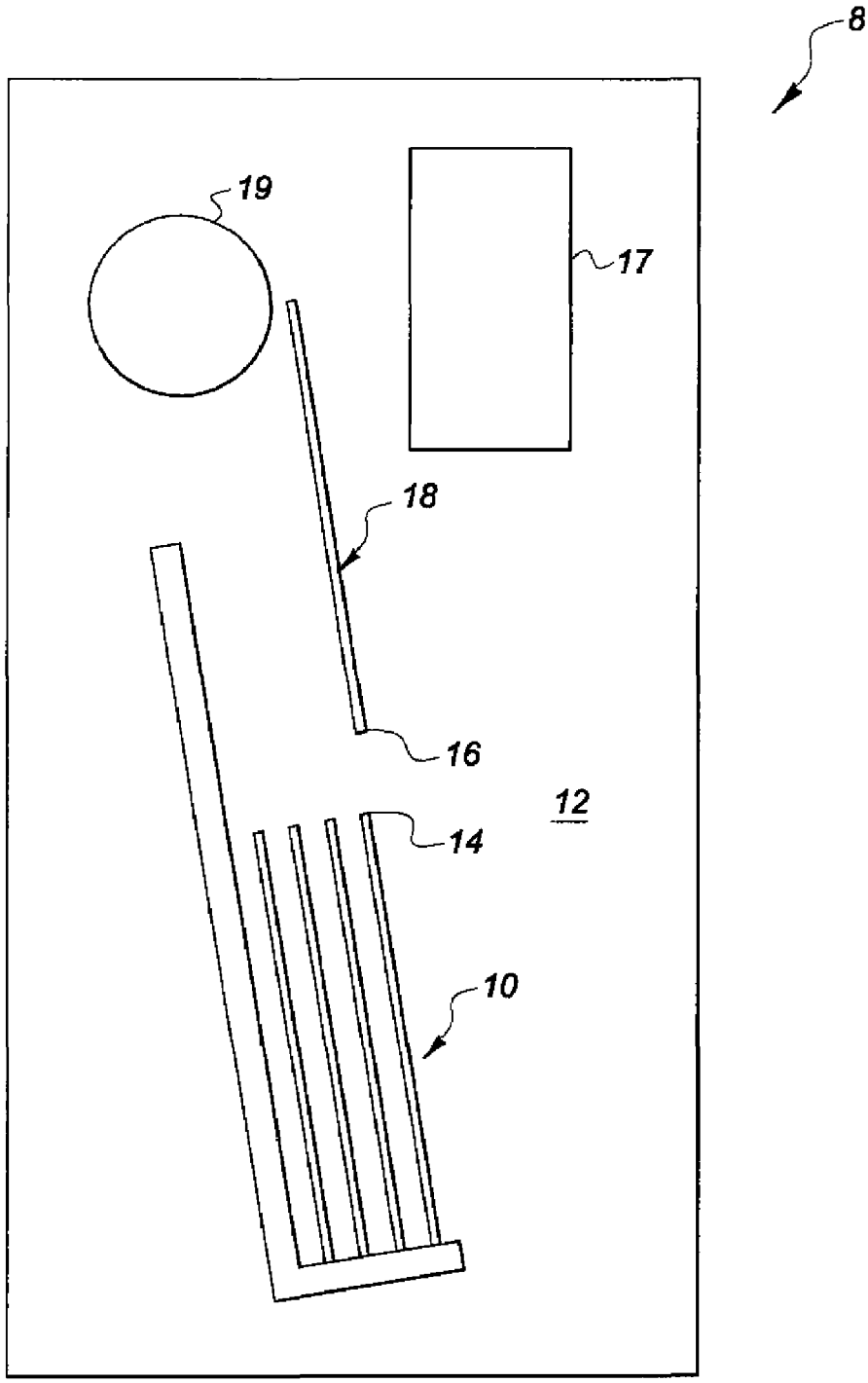
FIG. 1 (PRIOR ART)
FIG. 1 illustrates one example of a prior art printer with a gravity feed print storage system arranged along a substantially vertical flow path.
Figure 2:
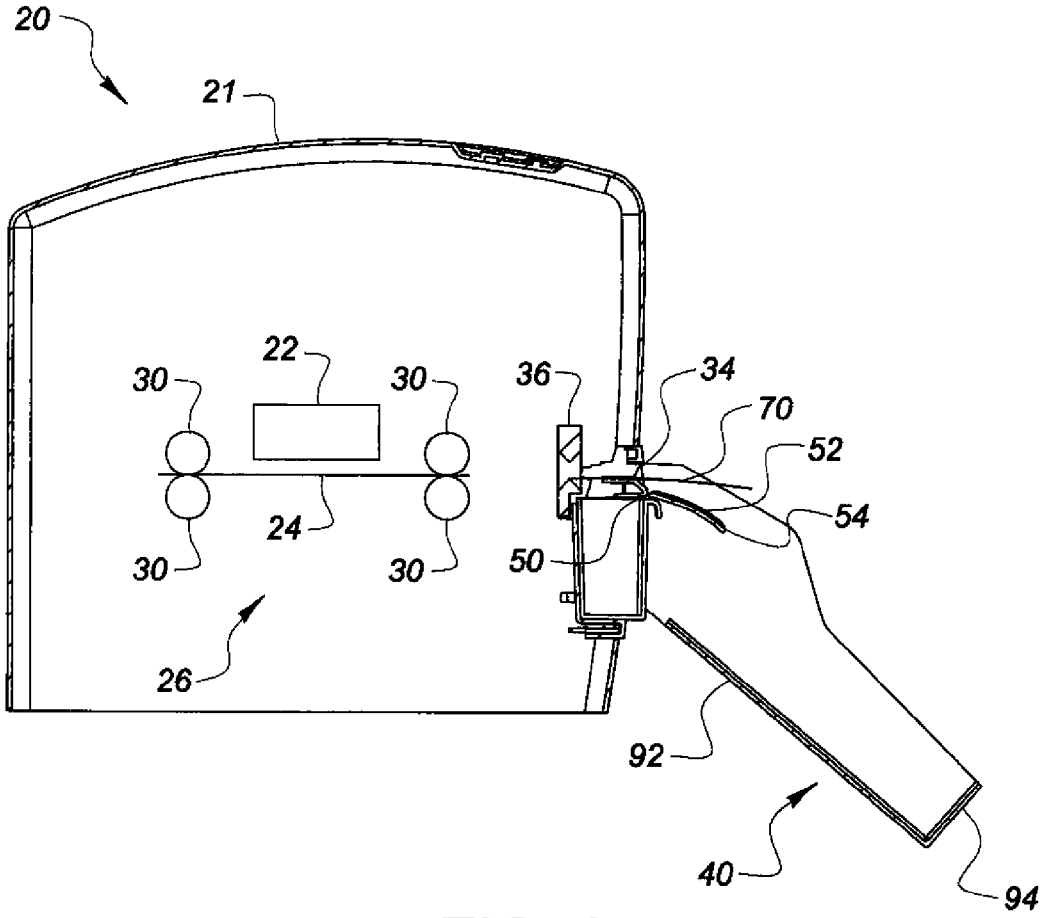
FIG. 2 shows a schematic illustration of a printer that can be used with a printed medium collector.
Figure 3:
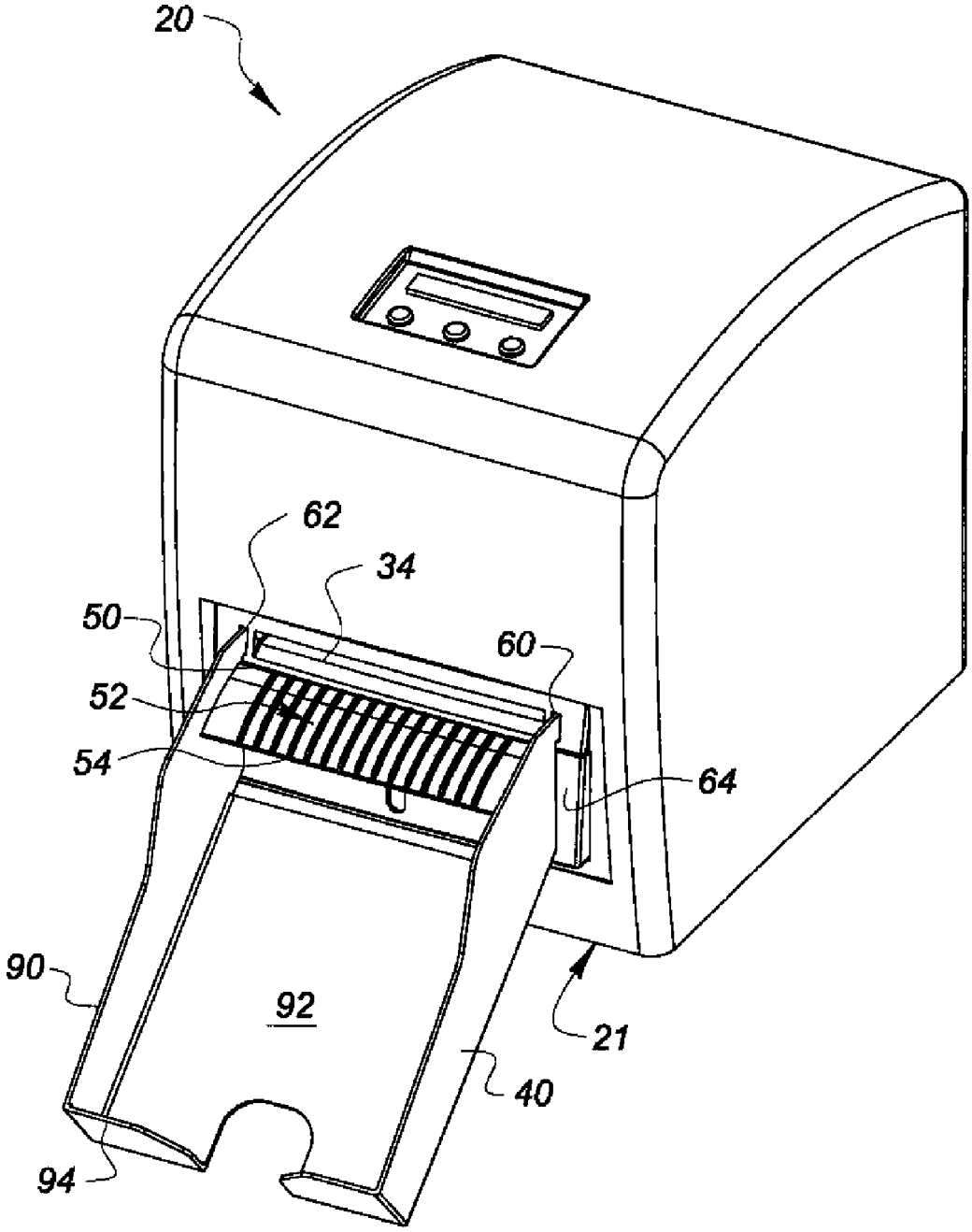
FIG. 3 is an exterior view of the printer of FIG. 2 connected to a printed medium collector.

FIGS. 2 and 3 show a printer 20 having one embodiment of a printed medium collector 40. In the embodiment of FIG. 2, printer 20 comprises a housing 21 having a print engine 22 that applies markings or otherwise forms an image on a receiver medium 24. Print engine 22 can record images on receiver medium 24 using a variety of known technologies including, but not limited to, conventional four color offset separation printing or other contact printing, silk screening, dry electrophotography such as is used in the NexPress 2100 printer sold by Eastman Kodak Company, Rochester, N.Y., USA, thermal printing technology, drop on demand ink jet technology and continuous inkjet technology. For the purpose of the following discussions, print engine 22 will be described as being of a type that generates color images. However, it will be appreciated that this is not necessary and that the claimed methods and apparatuses herein can be practiced with a print engine 22, monotone images such as black and white, grayscale or sepia toned images.

In printer 20, a medium advance 26 is used to position a receiver medium 24 and/or print engine 22 relative to each other to facilitate recording of a printed image (not shown) on receiver medium 24 to form a printed medium 70. Medium advance 26 can comprise any number of well-known systems for moving receiver medium 24 within printer 20, including a motor (not shown), pinch rollers 30, a motorized platen roller (not shown) or other well-known systems for the movement of paper or other types of receiver medium 24. Medium advance 26 is also adapted to advance a receiver medium 24 so that a printed medium 70 can pass through an exit area 34. Medium advance 26 is not adapted to provide further advancement of receiver medium 24 and thus does not require that moving components be supplied outside of printer housing 21 and does not require a medium advance 26 that is adapted to thrust printed medium 70 from exit area 34.

Printer 20 can be adapted to print images on cut sheet receiver mediums 24. Such cut sheet receiver mediums 24 can be identically sized or can be of different sizes between a smallest sized receiver medium 24 and a largest receiver medium 24. The size range of receiver medium 24 that can be used in printer 20 is typically a function of the type of medium advance 26 used, the type of printing, the size of the printing area provided by printhead 17 and other factors known to those of skill in the art. For example, one embodiment of printer 20 can print images on one size receiver medium 24 that is of a post card size or index card size and is further adapted to print images on a larger size receiver medium such as 11"×17" medium size. In another example, printer 20 can print images on 4"×6" receiver medium 24 and on 6"×8" receiver medium 24. Alternatively, an optional slitter or cutter 36 can be provided that can cut a continuous roll of receiver medium 24 into sized sheets match a wide range of sizes. As is illustrated in FIG. 2, such slitting typically occurs after printing of the image and is performed in a manner that separates printed medium 70 from the continuous roll of receiver medium 24.

The details of the operation of printer 20 are otherwise not critical and are well known to those of ordinary skill in the art.

As is illustrated in FIGS. 2-5, printed medium collector 40 is adapted to be positioned at exit area 34 of printer 20. In the embodiment illustrated, printed medium collector 40 provides at least one gripping surface 42 that is adapted to engage a mating surface of printer 20 so that an intake edge 50 of a guide surface 52 can be held proximate to an exit area 34 of printer 20 and so that as a printed medium 70 emerges from exit area 34, a leading edge 72 thereof passes over intake edge 50. During this stage, the printed medium 70 can be, for example, located at position of printed medium 70L in FIG. 5.

Figure 4:
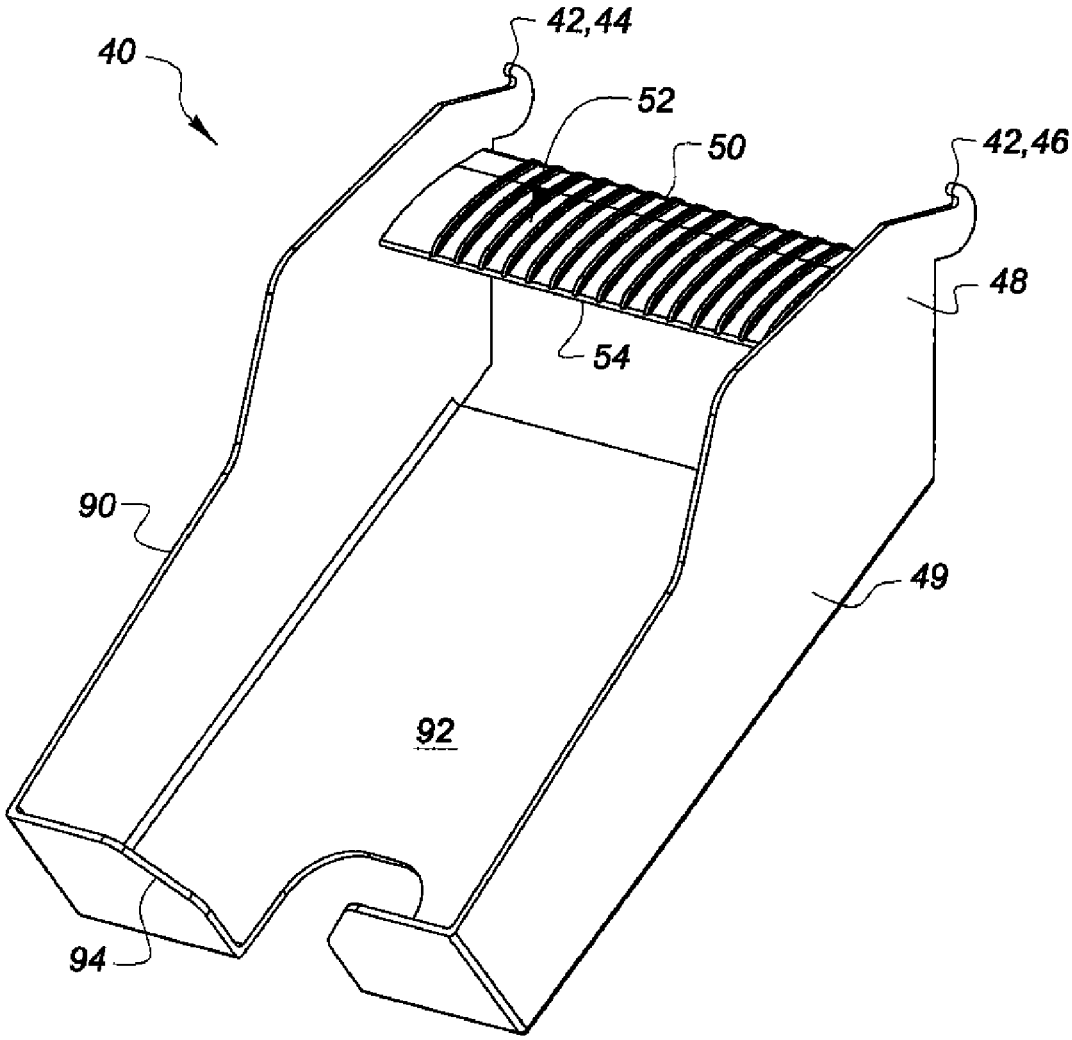
FIG. 4 illustrates the embodiment of the printed medium collector of FIG. 3 without a printer.

The at least one gripping surface 42 can take any of a variety of forms. In the embodiment that is illustrated in FIGS. 3 and 4, the at least one gripping surface 42 comprises attachment hooks 44 and 46. Attachment hooks 44 and 46 are adapted to engage slot holes 60 and 62 on front face 64 of printer 20 to mechanically join printer 20 and printed medium collector 40 at an upper portion 48 of printed medium collector 40, allowing a lower portion 49 to cantilever against housing 21.

It will be appreciated that the at least one gripping surface 42 can comprise any other known structure that can be used to define a fixed positional relationship between printer 20 and printed medium collector 40 such that intake edge 50 of guide surface 52 is held proximate to exit area 34. For example, and without limitation, the at least one gripping surface 42 can comprise a fastener, adhesive strip, magnetic attractant or the like. In another embodiment, again without limitation, the at least one gripping surface 42 can comprise an area intended to receive a fastener or other surface projected or extending from printer 20 into or through printed medium collector 40 to secure printed medium collector 40 in the desired positional relationship. In still another embodiment, printed medium collector 40 can be formed from a common substrate or joined as a common assembly with at least a part of housing 21.

It also will be appreciated that gripping surface 42 is optional and, that in other embodiments printed medium collector 40 can comprise any structure that can hold intake edge 50 of guide surface 52 such that a printed medium 70 released at exit area 34 of a printer 20 will fall or otherwise cross from exit area 34, over intake edge 50 and onto guide surface 52 extending from intake edge 50 to a drop-off edge 54.

Figure 5:
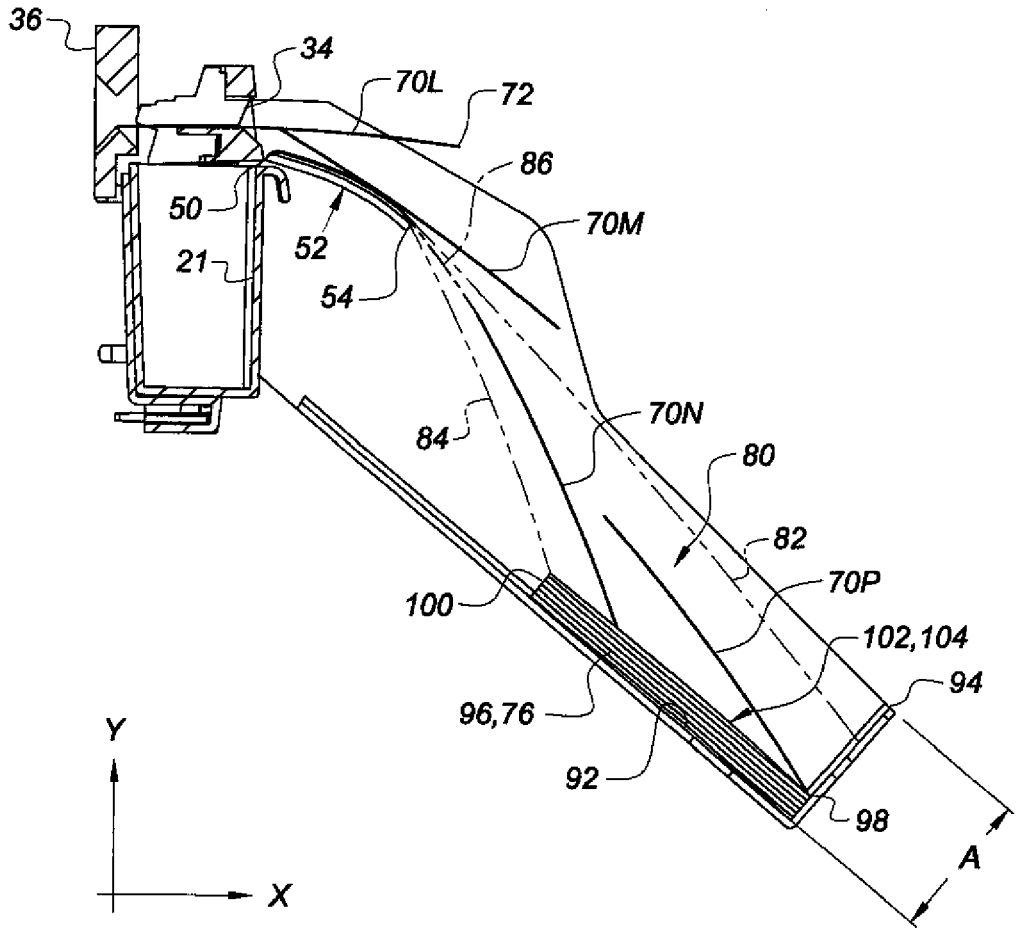
FIG. 5 provides a cross-sectional schematic view of a printed medium collector showing minimum and maximum trajectories for a leading edge of a printed medium.

As is shown in FIG. 5, guide surface 52 has the aforementioned intake edge 50 and a drop-off edge 54. Guide surface 52 is downwardly inclined from intake edge 50 to drop-off edge 54. The extent of the downward inclination is such that when printer 20 releases a printed medium 70 onto guide surface 52, printed medium 70 is drawn by gravity across guide surface 52 and over the drop-off edge 54. This can occur, for example, at printed medium 70M with a leading edge 72 of printed medium 70 moving within a range of trajectories 80 defined by a maximum trajectory 82 and a minimum trajectory 84. Each trajectory within range of trajectories 80 has a gravity influenced downward component along a Y axis and a lateral component along an X axis as illustrated in FIG. 5.

A printed medium storage area 90 is arranged to receive any printed medium 70 with a leading edge 72 moving within range of trajectories 80. Accordingly, printed medium storage area 90 is positioned downward of guide surface 52 and extends at least in part laterally away from drop-off edge 54. As illustrated, printed medium storage area 90 has a support surface 92 to provide support against downward movement of printed medium 70. Support surface 92 can be a solid surface or a surface having ribs or other supports to receive printed medium 70. A stop 94 is located at an end or other portion of support surface 92 that is laterally separated along the X axis from drop-off edge 54. Stop 94 extends above support surface 92 to an elevation A that is sufficient to engage a leading edge 72 of any printed medium 70 received by printed medium storage area 90. Once engaged, stop 94 blocks lateral travel of any such printed medium 70. Gravity operating on printed medium 70, and any downward momentum of printed medium 70, then causes printed medium 70 to come to a rest on support surface 92 generally positioned against stop 94. Elevation A of stop 94 is typically sufficient to allow a plurality of receiver mediums 24 to be retained in printed medium storage area 90 in the form of what will be referred to herein as stack 96 of stored printed mediums 76. Each stored printed medium 76 has a leading edge 98 that is generally positioned against stop 94 and a trailing edge 100 that is positioned along support surface 92 at a distance from stop 94 that is generally determined by a length B of stored printed medium 76.

Support surface 92 and stop 94 are further positioned at an elevation and at a lateral location relative to the drop-off edge 54 such that the leading edge 72 of a printed medium 70 that follows the range of trajectories 80 will laterally travel past a trailing edge 100 of each of stored printed mediums 76 before leading edge 72 passes downward of such trailing edge 100. In this way, leading edge 72 of printed medium 70 does not contact any of trailing edges 100 in stack 96 and is free to fall such that it makes first contact with an upper surface 102 of an uppermost 104 one of stored printed mediums 76 in stack 96 as illustrated by printed medium 70N in FIG. 5. Leading edge 72 is permitted to slide against upper surface 102 until leading edge 72 strikes stop 94 as illustrated by printed medium 70P in FIG. 5. Alternatively, printed medium 70 is permitted to travel along a trajectory (not shown) within the range of trajectories 80 such that leading edge 72 makes first contact with stop 94.

Figure 6A:
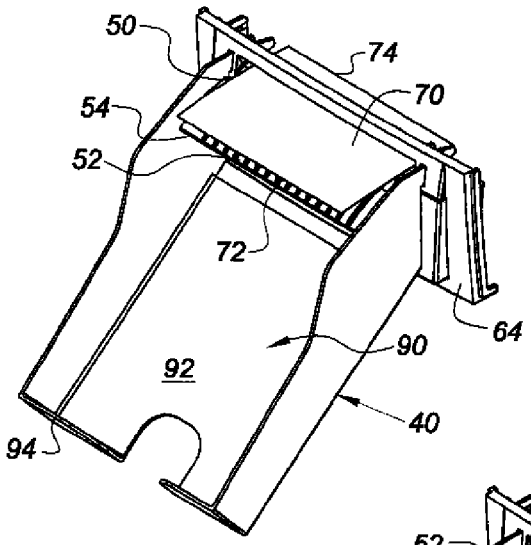
FIGS. 6A-6C illustrate a cycle of movement of a printed medium.
Figure 6B:
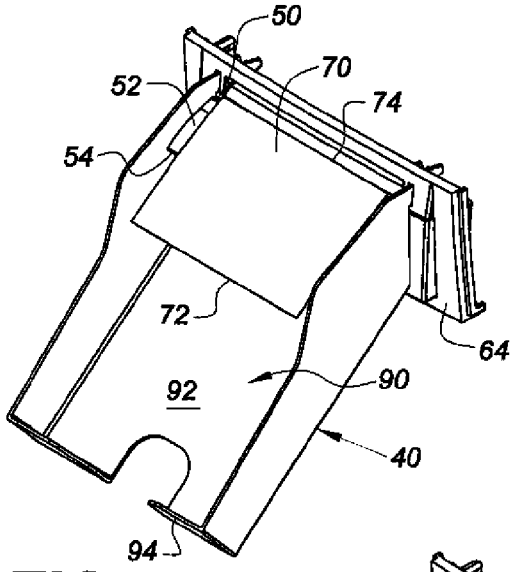
Figure 6C:
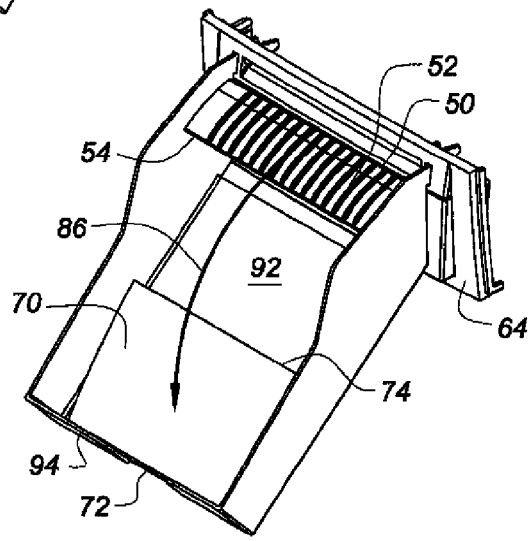

FIGS. 6A-6C illustrate in perspective, the movement of a printed medium 70 caused by guide surface 52 when no printed medium 70 is collected in printed medium storage area 90. As shown in FIG. 6A, during printing or immediately thereafter, leading edge 72 of printed medium 70 passes from exit area 34. This allows printed medium 70 to travel along guide surface 52 (FIG. 6B) without interference from printer 20. Typically, this occurs when medium advance 26 (not shown in FIGS. 6A-6C) can no longer engage printed medium 70. As this occurs, printed medium 70 can move freely from exit area 34. This, in turn, allows printed medium 70 to be drawn by gravity from intake edge 50 over drop-off edge 54 so that leading edge 72 travels along a trajectory 86 within the range of downward trajectories 80 and strikes either support surface 92 or stop 94.

As is illustrated in FIGS. 5 and 6A-6C the range of trajectories 80 is bounded in part by a maximum trajectory 82 that can be defined as a trajectory at which leading edge 72 of printed medium 70 has first contact with stop 94. As is illustrated in FIGS. 5 and 6C, when this occurs horizontal movement of leading edge 72 is halted. This causes the trailing edge 74 of printed medium 70 to fall with gravity toward support surface 92. This falling action tends to trap air between printed medium 70 and support surface 92 which acts as a cushion slowing the descent of trailing edge 74. The exact position of the maximum trajectory can be determined using any of a number of factors. Typically, the maximum trajectory will be selected so that it is low enough to avoid the risk that leading edge 72 will pass over stop 94 or will gain so much momentum during transit that printed medium 70 can pivot over stop 94. Alternatively, the maximum trajectory 82 can be defined at a point that brings leading edge 72 into first contact with support surface 92 or stored printed medium 76 on support surface 92.

Figure 7:
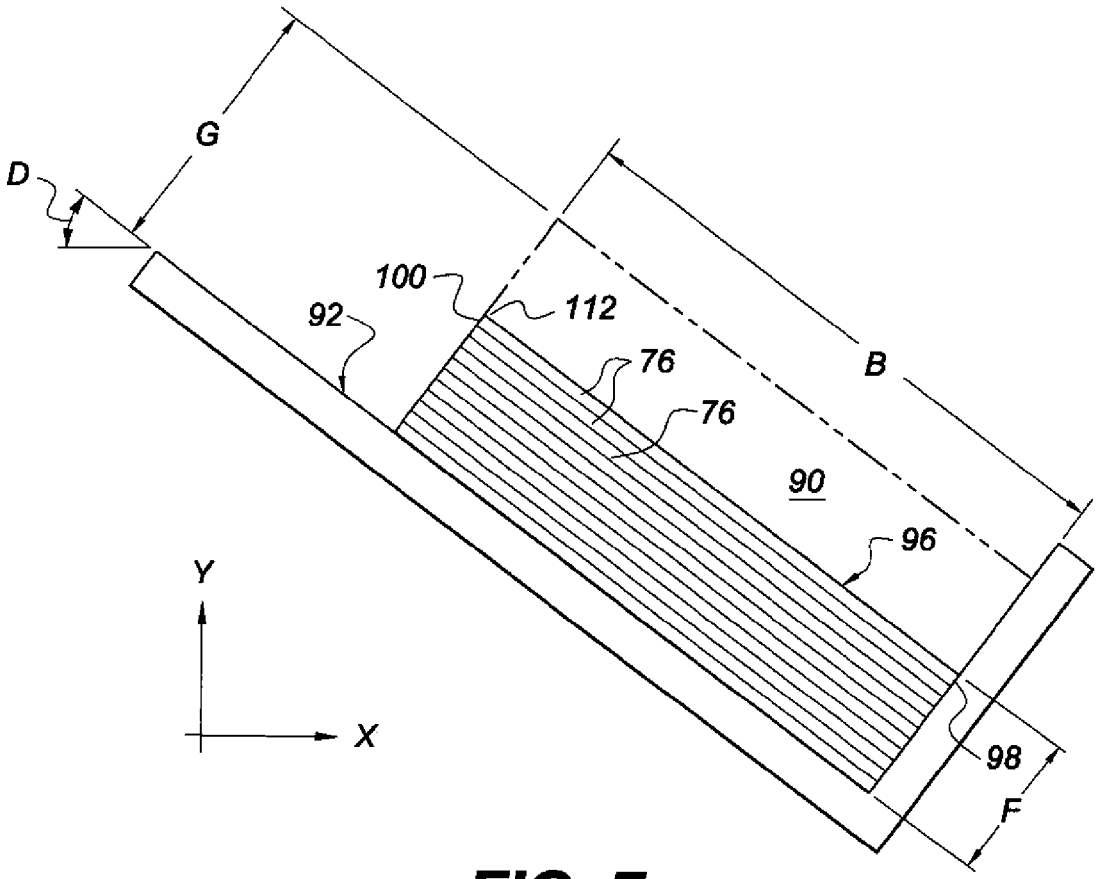
FIG. 7 provides a schematic illustration of a portion of a print storage area with a stack of stored printed mediums thereon.

The determination of the minimum trajectory 84 is made in a different fashion. FIG. 7 presents a magnified view of a print storage area of FIG. 5 with a stack when support surface 92 has a stack 96 of stored printed mediums 76 thereon. As can be seen, and as noted above, the trailing edges 100 of each stored printed medium 76 of stack 96 is a potential point of interference with the movement of leading edge 72 of printed medium 70. Minimum trajectory 84 is therefore defined so as to ensure that such interference does not occur.

It will be appreciated that this requires careful consideration of several factors, including the physical properties of the printed medium 70 such as, but not limited to, mass, shape, width and stiffness, the downward distance between drop-off edge 54 and stop 94, the lateral distance between drop-off edge 54 and stop 94, the length B of printed medium 70 and the angle of inclination C of guide surface 52 used to incite gravitational acceleration of printed medium 70 and any drag imposed on printed medium 70 by guide surface 52 or by the frictional characteristics of printed medium 70 and the angle of inclination D of support surface 92. In one embodiment, angle of inclination C of guide surface 52 must be, for example, large enough such that printed medium 70, considering the above described physical properties, continues to slide downward in a lateral direction without interruption. Failure to do so could leave printed medium 70 stalled on guide surface 52 potentially creating a paper jam condition when the next print collides with it.

Figure 8:
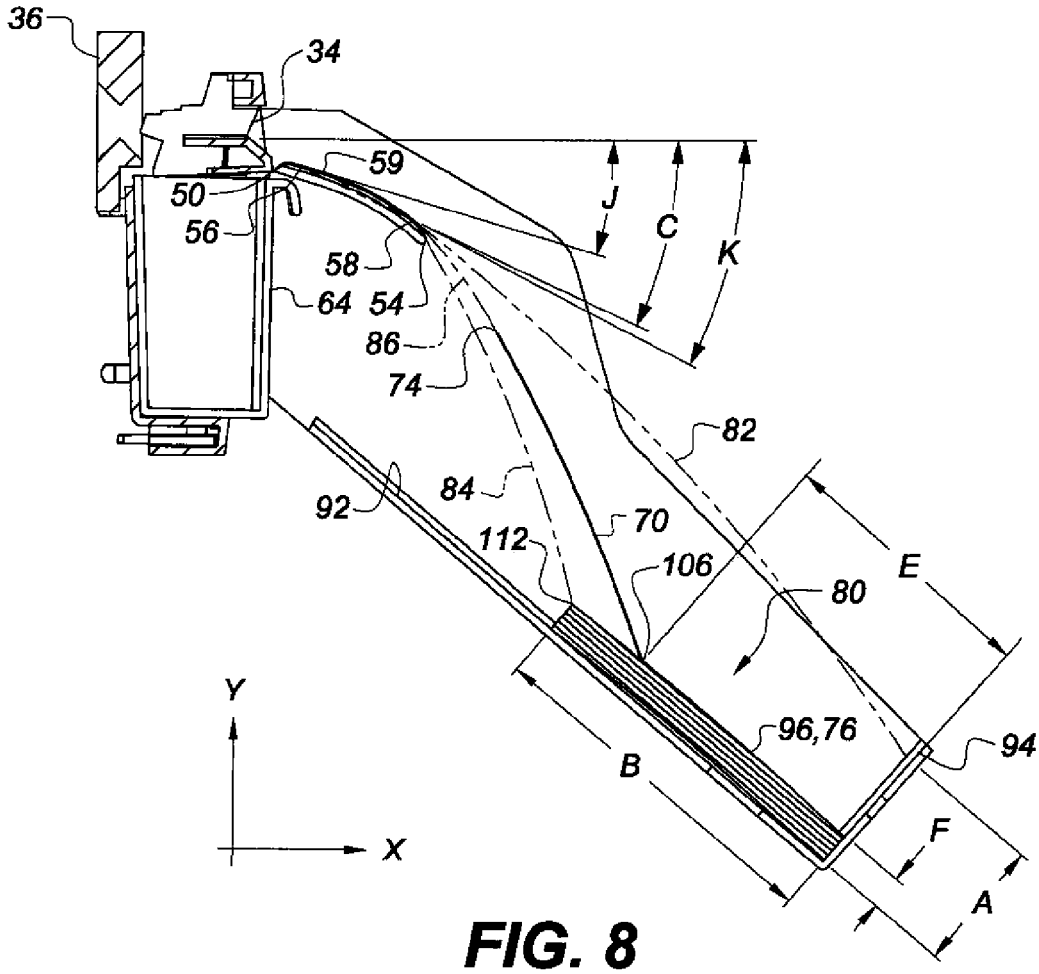
FIG. 8 illustrates a side section view of a printed medium collector with a printed medium in first contact with a stack of stored printed mediums.

Further, as is illustrated in FIGS. 7 and 8 and as noted above the minimum trajectory 84 is set so that lateral movement of printed medium 70 causes leading edge 72 of printed medium 70 to pass each of the trailing edges 100 of stored printed medium 76 along the lateral direction X before leading edge 72 passes the same trailing edges 100 in the downward direction Y so that leading edge 72 of printed medium 70 has a point of first clearance point 106 with an object after leaving guide surface 52 at a distance E (shown in FIG. 8) from stop 94 that is less than the length of printed medium 70. This however, also requires consideration of the stack height of stack 96 in that a minimum trajectory 110 that would allow leading edge 72 to laterally pass trailing edges 100 before downwardly passing trailing edges 100 for a stack 96 having a partial stack height F be inappropriate for a predetermined high stack height of G. Accordingly, it can be useful to define a minimum trajectory 84 that is at least sufficient so that a leading edge 72 of a printed medium 70 laterally passes over a clearance point 112 defined as a distance from stop 94 that is equivalent to the length of printed medium 70 and that has at least the predetermined high stack height of G. Predetermined high stack height G can be, for example, a height that will allow only one more printed medium 70 to be stored against stop 94.

The minimum trajectory can be established either by controlling or influencing the amount of energy supplied to printed medium 70 by gravity as printed medium 70 passes along guide surface 52, such as by adjusting the angle of inclination C of guide surface 52 to ensure that the printed medium has at least a minimum amount of lateral momentum as it leaves drop-off edge 54.

In the embodiment illustrated, guide surface 52 defined with a first portion 56 at the angle of inclination J and a second portion 58 that is downwardly inclined at a greater angle of inclination K than the angle of inclination J of guide surface portion 56 to minimize contact between printed medium 70 and guide surface 52 as printed medium 70 travels across guide surface 52. This reduces the amount of friction to which printed medium 70 is exposed as printed medium 70, allowing the leading edge 72 to follow a trajectory within the range of trajectories 80. By providing a guide surface 52 having a first portion 56 downwardly inclined at the angle of inclination J and a second portion 58 downwardly inclined at a greater angle of inclination K, leading edge 72 of printed medium 70 passes over an inflection point 59 between first portion 56 and the second portion 58 after which leading edge 72 and portions of printed medium 70 proximate to leading edge 72 are unsupported by guide surface 52 while trailing edge 74 and portions of printed medium 70 proximate to trailing edge 74 pass between intake edge 50 toward inflection point 59. This continues so long as a greater portion of printed medium 70 is on a side of inflection point 59 that is closer to intake edge 50 than to drop off edge 54. However, at some point, the portion of printed medium 70 that is positioned in the path of travel of printed medium 70 after inflection point 59 becomes greater than the portion that is positioned in the path of travel of printed medium 70 before inflection point 59. This causes printed medium 70 to cantilever on inflection point 59 as is illustrated by position of printed medium 70M. It can be appreciated the guide surface 52 angle of inclination can be created from one of one or more angular or segmented surfaces joined together to form a contiguous surface.

When printed medium 70 is in this cantilevered position, the amount of friction resisting the movement of printed medium 70 on guide surface 52 is substantially reduced, thus allowing printed medium 70 to travel along guide surface 52 toward drop off edge 54 with reduced friction acting against printed medium 70. This can be used to preserve much of the lateral and downward momentum imposed by gravitational acceleration of printed medium 70 during travel of the printed medium 70 across first portion 56. This can also be used to allow better control of the movement of printed medium 70 as it transitions from a movement path guided by contact with guide surface 52 to a trajectory guided generally by momentum and gravity.

The exact location of inflection point 59 may vary based upon characteristics of the printed medium 70 such as the curvature if any of printed medium 70. However, guide surface 52 is adapted so that the location of inflection point 59 is such that the lateral and downward momentum of printed medium 70 when such cantilevering effect begins is such as to cause leading edge 72 to travel within the range of trajectories 80 after printed medium 70 is no longer positioned by guide surface 52.

This arrangement helps to prevent frictional forces acting on printed medium 70 from stalling the movement of printed medium 70 such that movement of printed medium 70 across guide surface 52 ceases. Further, this arrangement helps to ensure that printed mediums of all sizes will experience such a cantilevered drop-off at generally the same location on guide surface 52. This allows both shorter and longer printed mediums 70 to begin unguided travel at the same time.

It will be appreciated that a guide surface 52 can be provided that has other arrangements for providing an inflection point 59, such as for example providing a guide surface 52 with a curvature or similar feature that enables low friction movement transition from movement of printed medium The minimum trajectory 84 can also be controlled by adjusting both the downward travel distance between guide surface 52 and support surface 92 so that the lateral momentum of printed medium 70 has a longer period of time to move printed medium 70 in the lateral direction before leading edge 72 travels sufficiently far in a downward direction to present a risk that leading edge 72 might pass below clearance point 112.

The minimum trajectory 84 can also be controlled by adjusting the travel distance along the lateral axis X from drop-off edge 54 to stop 94 such that the lateral travel distance is minimized and allowing a shorter minimum trajectory 84.

Figure 9:
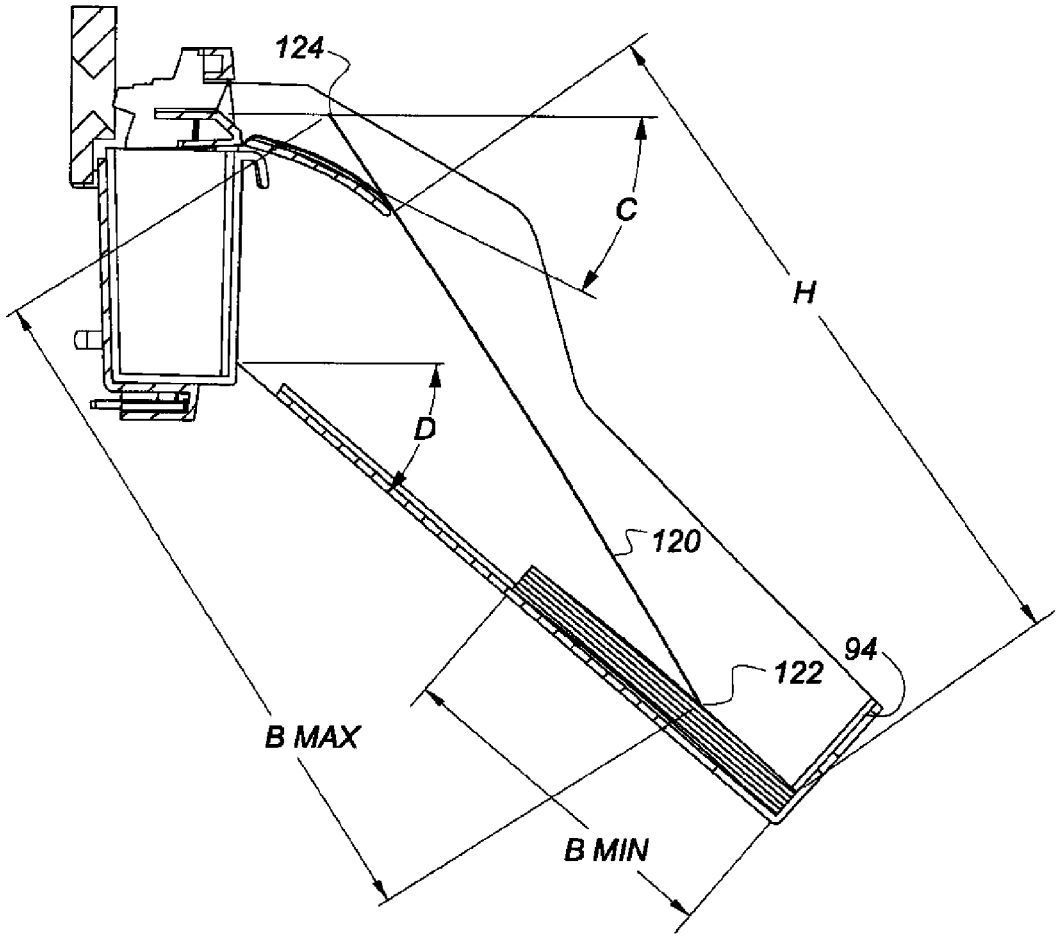
FIG. 9 illustrates a side section view of a printed medium collector with a large size printed medium moving from a guide surface to the printed medium storage area and with a stack small size printed medium stored thereon.

However, as is illustrated in FIG. 9, where printer 20 is adapted to print differently sized images, it is necessary that there be sufficient distance between stop 94 and the largest sized print medium 120 such that the leading edge 122 of the largest size printed medium 120 can be positioned against stop 94 without a trailing edge 124 being caught on guide surface 52. Accordingly, a distance H between a point on stop 94 and drop-off edge 54 should be close to or greater than the maximum length Bmax of largest sized printed medium 120. This places practical limitations on the proximity of stop 94 and drop-off edge 54. Further, in such a case it will be appreciated that the minimum trajectory 84 will be determined by both of the preferred high stack height G of a stack of stored printed medium 76 of a minimum length Bmin. This is because such a stack 96 of a stored printed medium 76 having a minimal length will have trailing edges 100 that are farthest from drop-off edge 54 and thereby require the greatest length of lateral travel for leading edge 72 to ensure that leading edge 72 laterally passes each of the trailing edges of stack 96 before leading edge 72 passes below each of trailing edges 100.

When printed medium collector 40 is used with a printer that is capable of printing multiple lengths of printed mediums 70, guide surface 52 can be positioned so that drop-off edge 54 is positioned at a distance that is less than a minimum length Bmin of printed medium 70. This can be accomplished by close positioning of guide surface 52 exit area 34 of printer 20 and can also be accomplished by defining the length of guide surface 52 between intake edge 50 and drop-off edge 54 as being less than minimum length Bmin. This can help for example to draw any portions of a Bmin length printed image from exit area 34 and over drop-off edge 54 with an appropriate amount of lateral momentum. However, it will be appreciated that, in other embodiments the angle of inclination C of guide surface 52 can be modified so that a Bmin length printed medium 70 will provide such movement and lateral momentum using a guide surface that is longer than the minimum length Bmin.

The invention has been described in detail with particular reference to certain preferred embodiments thereof, but it will be understood that variations and modifications can be effected within the spirit and scope of the invention.

PARTS LIST

8 prior art printer
10 previously printed sheets
12 storage area
14 trailing edges of previously printed sheets
16 leading edge
17 printhead
18 recently printed sheet
19 platen
20 printer
21 housing
22 print engine
24 receiver medium
26 medium advance
30 pinch rollers
34 exit area
36 cutter/slitter
40 printed medium collector
42 gripping surface
44 attachment hook
46 attachment hook
48 upper portion
49 lower portion
50 intake edge
52 guide surface
54 drop-off edge
56 first portion of guide surface
58 second portion of guide surface
60 slot hole
62 slot hole
64 front face
70 printed medium
70L printed medium
70M printed medium
70N printed medium
70P printed medium
72 leading edge
74 trailing edge
76 stored printed medium
80 range of trajectory
82 maximum trajectory
84 minimum trajectory
86 trajectory
90 printed medium storage area
92 support surface
94 stop
96 stack
98 leading edge
100 trailing edge
102 upper surface
104 upper most stored printed medium
106 clearance point
110 minimum trajectory
112 clearance point
120 largest size of printed medium
122 leading edge of largest size of printed medium
124 trailing edge of largest size of printed medium
A stop elevation
B medium length
C guide surface angle of inclination
D support surface angle of inclination
E distance from stop to point of first contact of leading edge
F partial stack height
G high stack height
H distance between stop and drop off edge
J angle of inclination of printed medium
K angle of inclination of printed medium
Bmax maximum length of printed medium
Bmin minimum length of printed medium

The invention claimed is:

1. A printed medium collector, comprising:

a guide surface having an intake edge and a drop off edge, with the guide surface being downwardly inclined from the intake edge to the drop off edge such that when a printer releases a printed medium onto the guide surface, the printed medium can be drawn by gravity across the guide surface and over the drop off edge with a leading edge of the printed medium moving within a range of trajectories, each trajectory having a downward and lateral component; and a printed medium storage area arranged to receive a printed medium with a leading edge moving within the range of trajectories, said printed medium storage area having a support surface to provide support against downward movement of the printed medium and a stop extending above the support surface to an extent that is sufficient to engage a leading edge of any printed mediums received by the print storage area to block lateral travel of said printed mediums so that such printed mediums are stored on the support surface against the stop to form a stack, such that said range of trajectories comprises a maximum trajectory in which the leading edge of the printed medium is capable of first contacting the stop, and a minimum trajectory where the leading edge of the printed medium is capable of contacting a location on a printed medium on the support surface which is at or just past a trailing edge of the printed medium on the support surface;

said support surface and said stop being positioned at an elevation and at a lateral location relative to the drop off edge such that the leading edge of a printed medium that follows the range of trajectories will laterally travel past the trailing edge of each of the printed mediums in the stack before the leading edge passes downward of the trailing edge of that printed medium.

2. The printed medium collector of claim 1, wherein said drop off edge is separated from said stop by a distance that is greater than a length of the printed medium.

3. The printed medium collector of claim 1, wherein said guide surface is downwardly inclined at an angle of inclination is large enough such that the printed medium, considering the physical properties of the printed medium, continues to slide downward without interruption, said properties including at least one of the length, width, mass, or stiffness of the printed medium.

4. The printed medium collector of claim 1, wherein said guide surface comprises a first portion at an angle of inclination and a second portion at a greater angle of inclination than the first portion.

5. The printed medium collector of claim 1, wherein said guide surface has a first portion that is inclined so that the said gravitational acceleration on the printed medium causes the leading edge to travel within the range of trajectories and a second portion that is more inclined than the first portion to minimize contact between the printed medium and the guide surface as the printed medium travels across guide surface.

6. The printed medium collector of claim 1, further comprising at least one gripping surface adapted to engage a mating surface of a printer so that an intake edge of a guide surface can be held proximate to an exit area of the printer.

7. A printed medium collector comprising:

a printed medium storage area having a downwardly inclined support surface with a stop, said stop extending above the downwardly inclined support surface to hold a predetermined stack of stored printed mediums on the support surface, said predetermined stack being of a high height relative to the support surface and extending along the support surface at least by a minimum length of the stored printed mediums within the stack, to define a clearance point at a lateral position and at an elevation of a trailing edge of an uppermost receiver medium in the predetermined stack;

a guide surface downwardly inclined from an exit area of a printer from which printed mediums exit from the printer toward the printed medium storage area to an extent that causes a printed medium that is released from said print exit area to be accelerated by gravity to travel across the guide surface and off of the guide surface to the printed medium storage area, said downward inclination of the guide surface is further inclined in a manner that causes a printed medium to travel along a one of a range of downward trajectories that each have a lateral component and a downward component;

wherein each of the trajectories causes the leading edge of the printed medium to laterally pass the clearance point before the leading edge of the printed medium passes downward of the elevation of the clearance point.

8. The printed medium collector of claim 7, wherein said printed medium is released at a position within the printer that is separated from a point where leading edge of the printed medium leaves the guide surface by a distance that is less than a length of a printed medium of a minimum length.

9. The printed medium collector of claim 7, further comprises at least one gripping surface adapted to engage a mating surface of a printer so that an intake edge of the guide surface can be held proximate to the exit area of the printer.

10. The printed medium collector of claim 7, wherein said guide surface comprises a first portion at an angle of inclination and a second portion at a greater angle of inclination than the first portion.

11. The printed medium collector of claim 7, wherein said guide surface has a first portion downwardly inclined at the angle of inclination and a second portion downwardly inclined at a greater angle of inclination than the first portion, so that the leading edge of the printed medium passes over an inflection point between the first portion and the second portion, after which leading edge and portions of printed medium proximate to leading edge are unsupported by guide surface while a portion of printed medium proximate to trailing edge passes between intake edge toward the inflection point with such unsupported travel continuing so long as a greater portion of printed medium is on a side of the inflection point that is closer to intake edge than to drop off edge, wherein at some point, the portion of printed medium that is positioned after the inflection point becomes greater than the portion that is positioned in the path of travel of printed medium before inflection point, causing printed medium to cantilever on the inflection point so that an amount of friction resisting the movement of printed medium on guide surface is substantially reduced thus allowing the printed medium to travel along guide surface toward drop off edge with reduced friction acting against such movement.

* * * * *